US009470422B2

(12) United States Patent
Wiebe et al.

(10) Patent No.: US 9,470,422 B2
(45) Date of Patent: Oct. 18, 2016

(54) GAS TURBINE STRUCTURAL MOUNTING ARRANGEMENT BETWEEN COMBUSTION GAS DUCT ANNULAR CHAMBER AND TURBINE VANE CARRIER

(71) Applicants: David J. Wiebe, Orlando, FL (US); Richard C. Charron, West Palm Beach, FL (US); Jay A. Morrison, Titusville, FL (US)

(72) Inventors: David J. Wiebe, Orlando, FL (US); Richard C. Charron, West Palm Beach, FL (US); Jay A. Morrison, Titusville, FL (US)

(73) Assignee: Siemens Energy, Inc., Orlando, FL (US)

( * ) Notice: Subject to any disclaimer, the term of this patent is extended or adjusted under 35 U.S.C. 154(b) by 389 days.

(21) Appl. No.: 14/059,521

(22) Filed: Oct. 22, 2013

(65) Prior Publication Data

US 2015/0107264 A1 Apr. 23, 2015

(51) Int. Cl.

| | |
|---|---|
| ***F23R 3/60*** | (2006.01) |
| ***F01D 9/02*** | (2006.01) |
| ***F23R 3/46*** | (2006.01) |

(52) U.S. Cl.

CPC ..... *F23R 3/60* (2013.01); *F01D 9/023* (2013.01); *F23R 3/46* (2013.01); *F05D 2260/30* (2013.01)

(58) Field of Classification Search

CPC ..... F01D 9/023; F23R 3/60; F23R 3/46
See application file for complete search history.

(56) References Cited

U.S. PATENT DOCUMENTS

| | | | | |
|---|---|---|---|---|
| 2,608,057 | A | 12/1949 | Boyd et al. | |
| 2,494,821 | A | 1/1950 | Lombard | |
| 3,609,968 | A | 10/1971 | Mierley, Sr. et al. | |
| 3,759,038 | A | 9/1973 | Scalzo et al. | |
| 4,478,551 | A | 10/1984 | Honeycutt, Jr. et al. | |
| 4,566,851 | A | 1/1986 | Comeau et al. | |
| 4,573,315 | A | 3/1986 | Stroem | |
| 5,706,646 | A * | 1/1998 | Wilde et al. | 60/39.37 |
| 7,637,716 | B2 | 12/2009 | Benton | |
| 7,762,766 | B2 | 7/2010 | Shteyman et al. | |
| 7,958,734 | B2 | 6/2011 | Paprotna et al. | |
| 2008/0236170 | A1 | 10/2008 | Weáver et al. | |
| 2010/0077719 | A1 | 4/2010 | Wilson et al. | |
| 2010/0180605 | A1 * | 7/2010 | Charron | 60/796 |
| 2011/0203282 | A1 | 8/2011 | Charron et al. | |

FOREIGN PATENT DOCUMENTS

| | | | |
|---|---|---|---|
| EP | 1865262 | A1 | 12/2007 |

* cited by examiner

*Primary Examiner* — Phutthiwat Wongwian
*Assistant Examiner* — Marc Amar

(57) ABSTRACT

A gas turbine engine ducting arrangement (10), including: an annular chamber (14) configured to receive a plurality of discrete flows of combustion gases originating in respective can combustors and to deliver the discrete flows to a turbine inlet annulus, wherein the annular chamber includes an inner diameter (52) and an outer diameter (60); an outer diameter mounting arrangement (34) configured to permit relative radial movement and to prevent relative axial and circumferential movement between the outer diameter and a turbine vane carrier (20); and an inner diameter mounting arrangement (36) including a bracket (64) secured to the turbine vane carrier, wherein the bracket is configured to permit the inner diameter to move radially with the outer diameter and prevent axial deflection of the inner diameter with respect to the outer diameter.

12 Claims, 4 Drawing Sheets

GAS TURBINE STRUCTURAL MOUNTING ARRANGEMENT BETWEEN COMBUSTION GAS DUCT ANNULAR CHAMBER AND TURBINE VANE CARRIER

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

The invention relates to a mounting arrangement for a can-annular combustion system of a gas turbine engine. Specifically, the arrangement permits relative radial motion yet prevents relative axial motion between an annular chamber of the combustion system and the turbine vane carrier to which the annular chamber is secured.

BACKGROUND OF THE INVENTION

Conventional can-annular gas turbine engines include a plurality of individual combustor cans, where each can is secured to a respective transition duct that directs combustion gases from the combustor can, and through inlet guide vanes to a respective portion of a turbine inlet annulus. Each flow of combustion gas remains discrete from the combustor until exiting the respective transition duct. In contrast, in certain emerging gas turbine engines that use can combustors, the array of transition ducts are replaced with a duct arrangement that receives the discrete combustion gas flows from repositioned combustor cans, accelerates them to a speed appropriate for delivery onto the first row of turbine blades, and directs them into a common duct structure that may include an annular chamber where the combustion gas flows are no longer segregated from each other. The annular chamber exhausts directly into the turbine inlet. (Other configurations exist where the individual flows remain discrete even within the common duct structure.) The proper orientation and speed created by the arrangement eliminates the need for a first row of inlet guide vanes present in the conventional arrangements. An example of this configuraton may be seen in US Patent Application Publication Number 2011/0203282 to Charron et al., published Aug. 25, 2011, which is incorporated by reference in its entirety herein.

In conventional gas turbine engine combustor arrangements, since the combustion gas flows are not accelerated a substantial amount in the transition ducts there is a relatively small static pressure difference between compressed air in the plenum surrounding the transition duct and a static pressure of the combustion gas flows within the transition. Consequently, there is a relatively small force pressing inward on the exterior surface of the transition ducts.

In contrast, in the emerging technology ducting arrangement the combustion gas flows are traveling at significantly greater speeds. This results in significantly greater pressure differences (up to six atmospheres) and resulting forces acting on the exterior surface of the ducting arrangement. In configurations with an accelerating geometry that accelerates the combustion gas flows to the proper speed for delivery onto the first row of turbine blades, such as the configuration with the annular chamber, the annular chamber experiences the greatest of these forces because the combustion gas flows are fully accelerated when in the annular chamber. These forces act to deform the ducting arrangement, in particular the annular chamber, and there is room in the art for improvements that resist this deformation.

BRIEF DESCRIPTION OF THE DRAWINGS

The invention is explained in the following description in view of the drawings that show.

DETAILED DESCRIPTION OF THE INVENTION

The present inventors have devised an innovative mounting arrangement that resists deformation of ducting associated with emerging technology can annular combustion arrangements. The mounting arrangement permits relative radial movement while preventing relative axial movement of the ducting with respect to the turbine vane carrier to which the ducting is mounted. In addition, the mounting arrangement provides a bracing function that helps the ducting retain its shape/profile despite pressure induced forces acting to deform the ducting.

Figure 1:
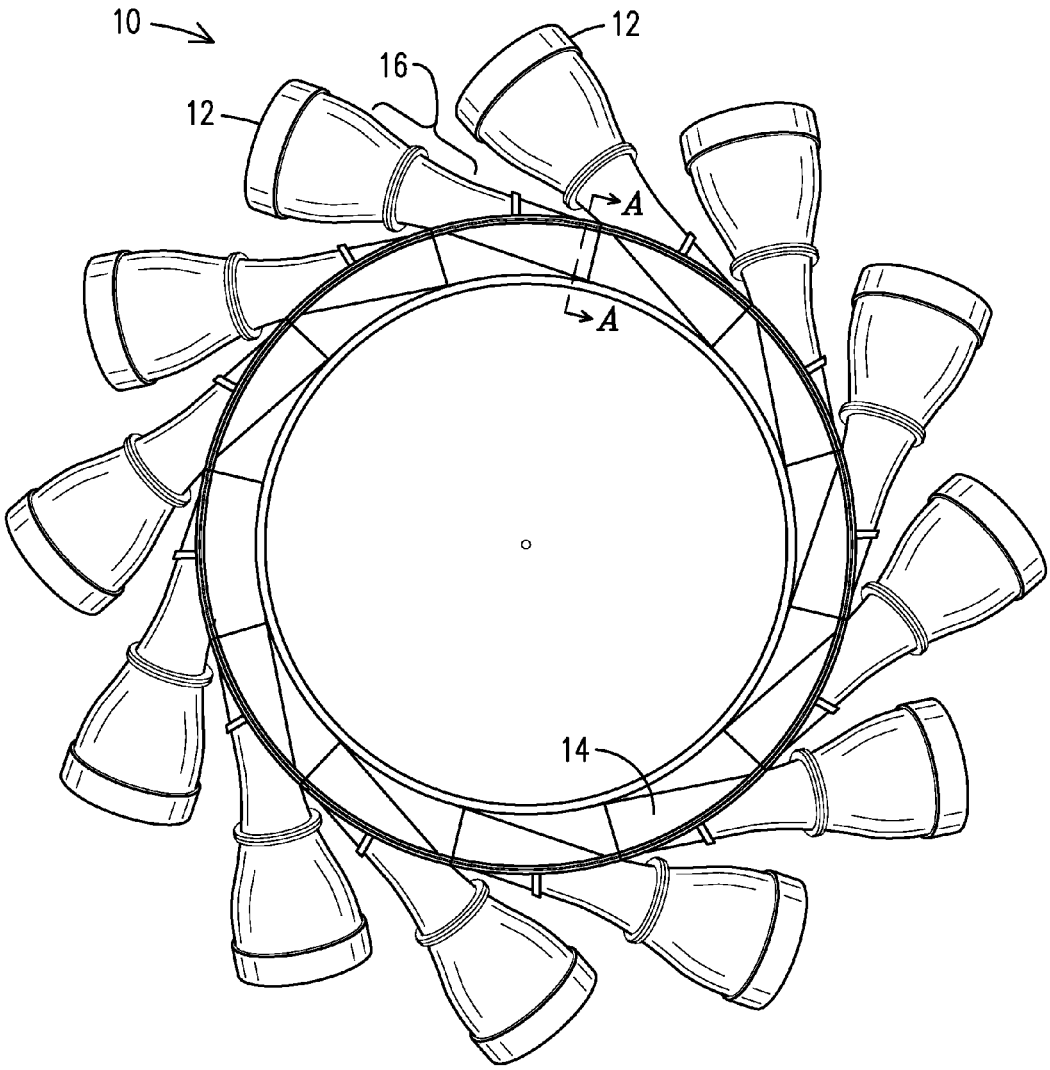
FIG. 1 is a schematic representation of a ducting arrangement that may use the mounting arrangement described herein.

FIG. 1 is a schematic representation of a ducting arrangement 10 that may be used with properly oriented can combustors (not shown), viewed looking from aft to fore. The ducting arrangement 10 receives combustion gases and guides them toward an inlet annulus (not shown) of a turbine (not shown). The ducting arrangement 10 may include a plurality of cones 12, each configured to receive a discrete flow of combustion gases emanating from a respective can combustor. Each cone 12 may be part of a discrete duct and each duct may merge into a common duct structure. The common duct structure may include an annular chamber 14 into which all combustion gas flows flow. An accelerating configuration 16 may be present to accelerate a combustion flow from a speed at which it travels when entering the cone 12 to a speed appropriate for delivery onto a first row of turbine blades (not shown), which could approach 0.8 mach and above.

Figure 2:
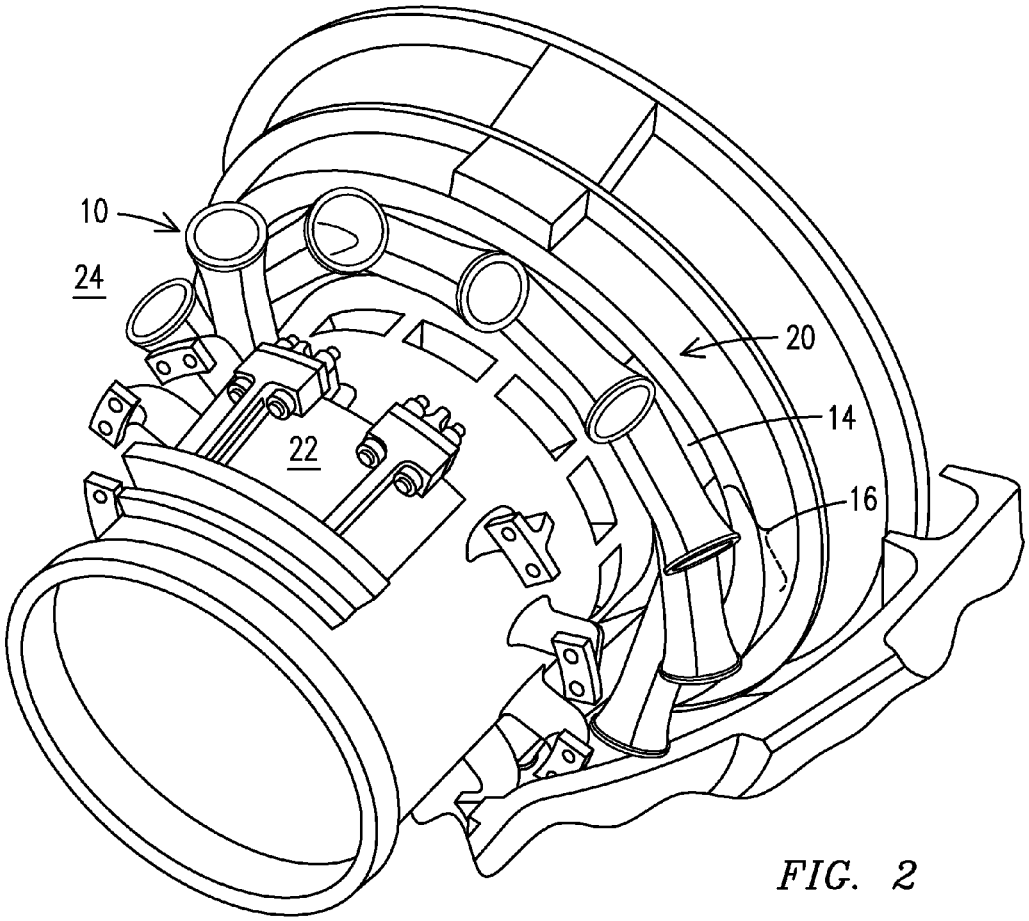
FIG. 2 is a schematic representation of the ducting arrangement of FIG. 1 positioned within a combustion section of a gas turbine engine.

FIG. 2 shows the ducting arrangement 10 (without the cones 12 for clarity) positioned within a turbine vane carrier 20 of a gas turbine engine. Compressed air exits a compressor exit diffuser 22 and enters a plenum 24 surrounding the ducting arrangement 10. The compressed air is moving relatively slowly in the plenum 24 as it moves toward an inlet (not shown) to the combustor cans (not shown). Once the compressed air is mixed with fuel and combusted in the can it is received by the ducting arrangement 10 and accelerated to a relatively fast speed approaching mach 0.8 and above via the accelerating configuration 16 partly visible in FIG. 2. Partially visible within the turbine vane carrier 20 is the annular chamber 14 which experiences the bulk of the pressure induced forces.

Figure 3:
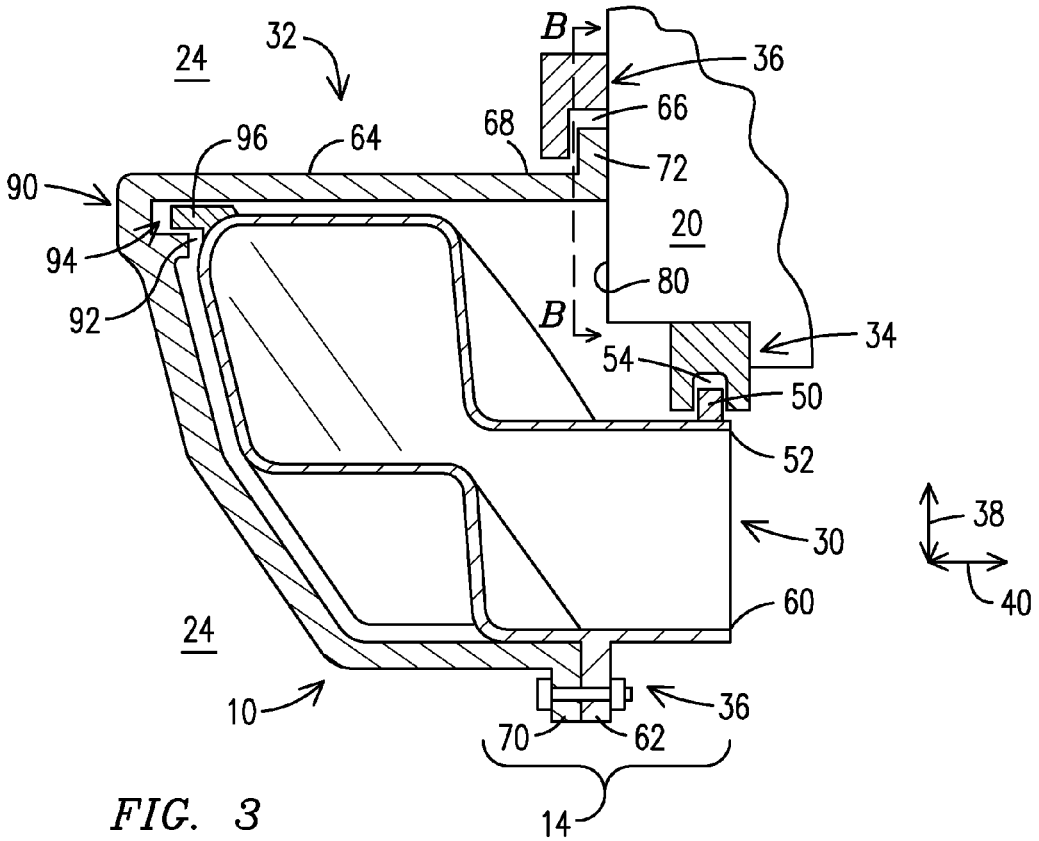
FIG. 3 is a schematic cross section along A-A of FIG. 1 of an annular chamber of the ducting arrangement within the combustion section of the gas turbine engine of FIG. 2 showing an exemplary embodiment of the mounting arrangement.

FIG. 3 is a cross section along A-A of FIG. 1, showing a common duct structure of the ducting arrangement 10 including the annular chamber 14. At an aft end of the annular chamber 14 is an outlet 30 from which the combustion gases exhaust prior to entering the turbine inlet annulus (not shown) immediately aft of the outlet 30. An exemplary embodiment of a mounting arrangement 32 includes an outer diameter mounting arrangement 34 and an inner diameter mounting arrangement 36. The outer diameter mounting arrangement 34 may permit motion in a radial direction 38 and restrict motion in an axial direction 40. This may be accomplished as shown in the exemplary embodiment by a slotted arrangement such as one formed by a radially oriented outer diameter flange 50 associated with an outer wall characterized by an outer diameter 52 of the annular chamber 14 and a radially oriented outer mount groove 54 fixed with respect to with the turbine vane carrier 20. (The flange and groove locations could readily be switched and still accomplish the same objective or relative radial but not axial movement.)

When engaged the outer diameter mounting arrangement 34 permits the outer diameter 52 of the annular chamber 14 to move radially with respect to the turbine vane carrier 20. This is very important because during transient events the two might heat and cool at different rates and this may cause relative thermal growth in a radial direction that requires relative radial movement to avoid thermal stresses between the two. Furthermore, vibration during operation may require the freedom of radial movement. However, relative axial movement must be prevented in order to keep the annular chamber 14 from reaching the first row of turbine blades.

The inner diameter mounting arrangement 36 refers to the arrangement required to secure an inner wall characterized by an inner diameter 60 of the annular chamber 14. The inner diameter mounting arrangement 36 is configured to permit relative radial movement and prevent relative axial movement and may include: an inner diameter flange 62 associated with the inner diameter 60 of the annular chamber 14, a bracket 64, and a radially oriented inner mount groove 66 fixed with respect to the turbine vane carrier 20. The bracket 64 includes a vane carrier end 68 and an annular chamber end 70. The vane carrier end 68 may include a bracket radially oriented flange 72 configured to fit within the radially oriented inner mount groove 66. The annular chamber end 70 may fixedly secure to the inner diameter flange 62. By fixedly secured it is meant that relative movement is not permitted at the location.

In this configuration it can be seen that the inner diameter 60 of the annular chamber 14 is secured, via the inner diameter flange 62, the bracket 64, the bracket radially oriented flange 72, and the radially oriented inner mount groove 66, to the turbine vane carrier 20 in a manner that permits relative radial movement and prevents relative axial movement between the inner diameter 60 and the turbine vane carrier 20. The bracket 64 will float with any radial movement of the inner diameter 60, and hence will float within the radially oriented inner mount groove 66. However axial movement will be prevented because the vane carrier end 68 of the bracket is prevented from axial movement by a fore surface 80 of the turbine vane carrier 20. An inherent rigidity of the bracket 64 will prevent the annular chamber end 70 from moving axially. The bracket 64 will be able to maintain its orientation via an interaction of the bracket radially oriented flange 72 and the radially oriented inner mount groove 66.

The mounting arrangement 32 may optionally include a supplemental support arrangement 90 that provides supplemental support for an additional location 92 of the ducting arrangement 10 at a supplemental support point 94 of the bracket 64 between the vane carrier end 68 and the annular chamber end 70. This may be accomplished via a sliding relationship of an additional tab 96 and the supplemental support point 94 that allows for thermal growth mismatch but still provides the necessary support for the inner diameter 60.

Supporting the ducting arrangement 10 and in particular the inner diameter 60 in this manner is important. The relatively high static pressure in the plenum 24 wants to bring the inner diameter 60 and the outer diameter 52 together. However, when the annular chamber is formed as a unified unit, this force is essentially accommodated by the ring shape of the annular chamber 14 itself. In the exemplary embodiment shown a unified unit includes an annular chamber 14 formed of multiple arc-sections that are secured together to form the annular chamber 14. There may be as many arc-sections as there are combustor cans. However, the number of sections need not be directly related to the number of combustor cans. For example, there could be six discrete sections instead of twelve, each section being associated with two adjacent combustor cans, or four discrete arc-sections each being associated with three combustor cans etc.

Edges of circumferentially adjacent sections may be, for example, bolted directly to each other. This reduces air leakage between adjacent sections and therefore increases engine efficiency. However, the pressure induced forces also push the inner diameter 60 aft, (to the right as shown) and without proper support the inner diameter 60 may tend to move aft. At the very least this will change a contour of the ducting arrangement 10. At the extreme end and under the proper conditions this could fatally buckle the ducting arrangement 10. The ducting arrangement 10 may be operated at higher temperatures that traditional transition ducts in order to reduce the amount of cooling air used, which in turn increases engine efficiency. The increased operating temperature brings the ducting arrangement closer to its operating limits and this reduces its structural strength. The above, plus the geometry of the annular chamber 14, net an arrangement where the thermal growth that occurs naturally during operation may be greater than the amount of strain it would take to cause the annular chamber 14 to yield. For all these reasons conventional brackets do not suffice in the new technology ducting arrangement 10.

Prior mounting arrangements have attempted to support the inner diameter by rigidly securing it to the turbine vane carrier 20, or by securing it to another part of the engine. Embodiments that rigidly secured the inner diameter 60 to the turbine vane carrier 20 were inadequate because the annular chamber 14 responds differently to thermal changes and hence there is relative thermal growth between the annular chamber 14 and the turbine vane carrier 20. The rigid connections resulted in an unacceptable thermal fight between the two. Embodiments that secured the inner diameter 60 to other locations often did not provide adequate support because the other locations added thermal growth differences of their own.

The present inventors recognized that it is necessary to give the annular chamber 14 the freedom to move radially with respect to the turbine vane carrier 20, and it is necessary to restrict its axial movement. The inventors further recognized that in order to provide the necessary radial movement freedom, both the inner diameter 60 and the outer diameter 52 needed to be radially free to move. They devised the current arrangement that effectively ties the inner diameter 60 and the outer diameter 52 to one component, the turbine vane carrier 20, and thus the thermal response of only the one component needed to be considered. The inventors further realized that when used in conjunction with a flange and groove arrangement for the outer diameter 52, a cantilever support with freedom of radial movement could satisfy both the need to provide radial movement freedom to the inner diameter 60 and the need to provide structural support/bracing (i.e. an exoskeleton-type function) for the ducting arrangement 10. Consequently, the bracket 64 may be secured in any number of ways to the ducting arrangement 10 so long as it achieves the goal of allowing relative radial movement and not relative axial movement with respect to the turbine vane carrier.

The bracket 64 may also be pre-stressed in a manner that is effective to counter pressure-induced forces on the inner diameter 60. For example, if movement in the axial direction 40 is to be countered, the bracket 64 could be pre-bent such that the supplemental support point 94 moves in a radially outward direction. When not under base load conditions the bracket 64 might tend to pull the inner diameter 60 to the left (fore), but the pull force at these lower pressure differentials would be within the structural capacity of the ducting arrangement 10. When under operation conditions the bracket 64 could be configured such that pressure differential pushes the inner diameter 60 to an operating position where there is reduced or no stress in the annular chamber 14. In this scenario most, if not all of the pressure-induced forces could be borne by the bracket 64 and radially oriented inner mount groove 66.

There may be any number of brackets 64 deemed necessary. For example, there may be one bracket 64 for each of the discrete arc-sections that constitute the annular chamber 14 in the exemplary embodiment shown. Alternately, there could be more or fewer brackets 64. For example, there could be two brackets 64 for each section. The annular chamber 14 exhibits a certain structural strength when bolted together, and thus there may be fewer than one bracket 64 per arc-section. The brackets may be evenly positioned about the circumference of the annular chamber 14, or their location may be selected based on localized needs, resulting in asymmetric positioning of the brackets 64 about the circumference.

Figure 4:
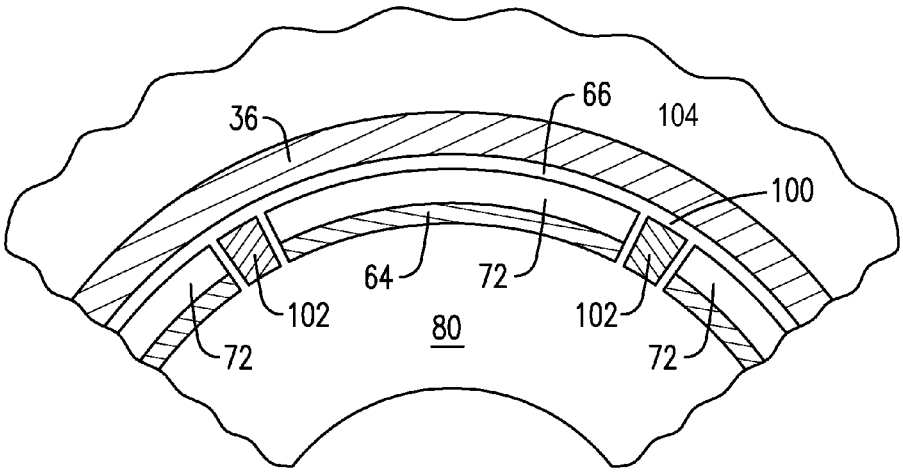
FIG. 4 is a view along B-B of FIG. 3.

As shown in FIG. 4, the bracket radially oriented flange 72 may include a spline groove 100 for a respective lug 102 that together form an anti-rotation arrangement 104 that prevents rotation of the bracket radially oriented flange 72 (and therefore the bracket 64) within the radially oriented inner mount groove 66. Alternately, the spline groove 100 may be formed between circumferentially adjacent radially oriented flanges 72. This anti-rotation (anti angular/circumferential) arrangement may be necessary to resist a tangential reaction load that may be generated in response to the combustion process. This tangential reaction load may act to rotate the ducting arrangement 10 and the lugs 102 prevent this rotation.

Figure 5:
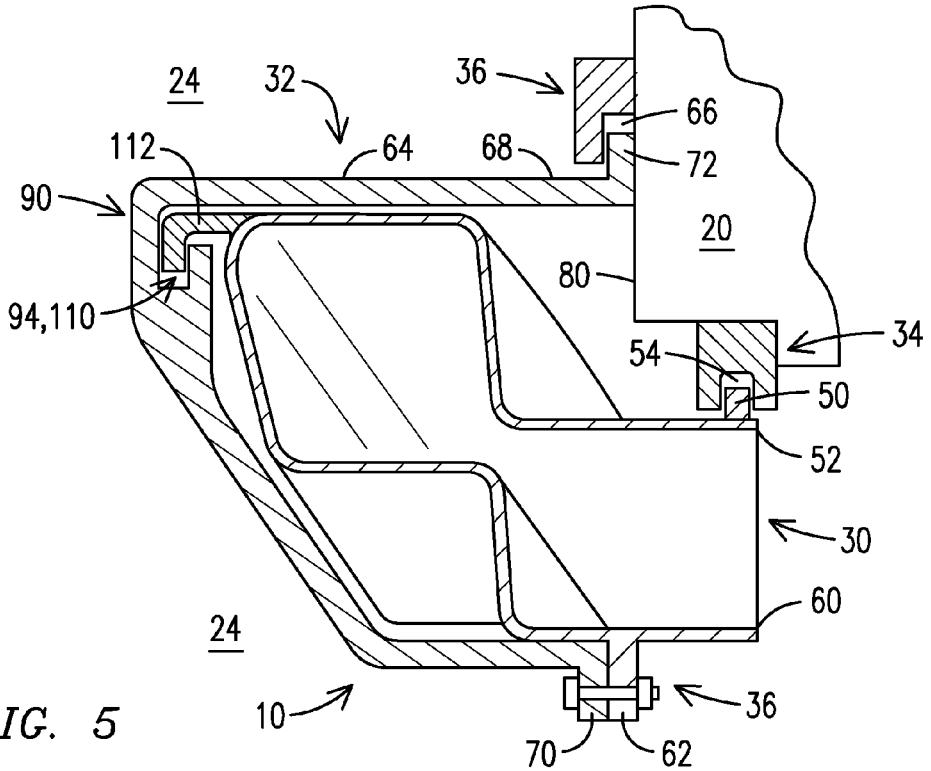
FIGS. 5-7 are alternate exemplary embodiments of the mounting arrangement.

FIG. 5 shows an alternate exemplary embodiment of the mounting arrangement 32. Here the annular chamber end 70 of the bracket 64 and the vane carrier end 68 are secured the same as in FIG. 3. The supplemental support arrangement 90 is different and includes a supplemental support slot 110 and a ducting arrangement flange 112 that cooperates with the supplemental support slot 110. The freedom to move radially but not move axially is preserved and the supplemental support is simply configured differently.

Figure 6:
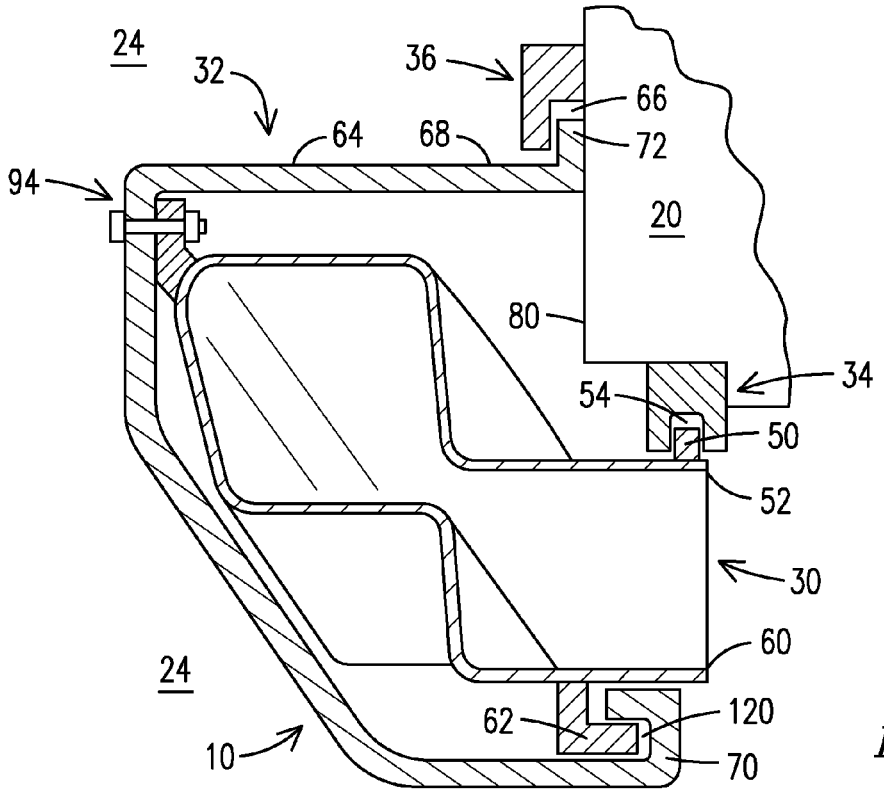
Figure 7:
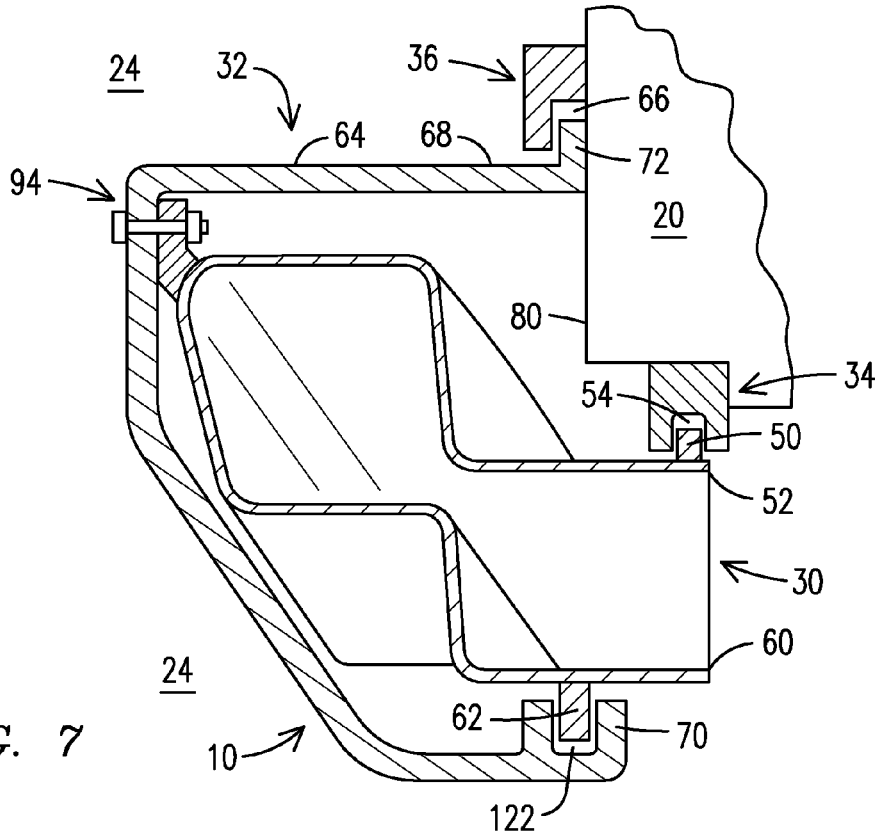

FIG. 6 shows an alternate exemplary embodiment of the mounting arrangement 32. Here the bracket 64 is fixedly secured at the supplemental support point 94. The annular chamber end 70 includes an annular chamber end axially oriented groove 120 configured to receive the inner diameter flange 62 when the inner diameter flange 62 is axially oriented. The vane carrier end 68 of the bracket 64 is secured the same as in FIG. 3. This arrangement provides the necessary relative radial freedom and restricts the axial motion of the inner diameter 60. FIG. 7 shows yet another alternate embodiment similar to that of FIG. 6, but where the annular chamber end 70 includes an annular chamber end radially oriented groove 122 configured to receive the inner diameter flange 62 when the inner diameter flange 62 is radially oriented. Various other embodiments could be used to implement the concepts. For example, the annular chamber end 70 of FIG. 6 or 7 could be implemented in the embodiment of FIG. 3. This would eliminate any fixed securement of the bracket 64 to the ducting arrangement 10. If properly dimensioned, however, this would be capable of providing the required relative radial motion while preventing the relative axial motion.

From the foregoing it can be seen that the inventors have devised an innovative solution to a unique problem associated with a new combustion arrangement design. The inventive mounting arrangement is an uncomplicated solution to a problem that was difficult to fully identify, and hence represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A gas turbine engine ducting arrangement, comprising: a ducting arrangement comprising a plurality of discrete ducts, each duct disposed between a respective combustor can and an annular chamber, the annular chamber configured to receive a combustion gas flow from each of the plurality of discrete ducts and to deliver the combustions gas flows to a turbine inlet annulus;

an outer diameter mounting arrangement at a location radially outward of the annular chamber with respect to a central axis of the annular chamber configured to permit relative radial movement and to prevent relative axial movement between an outer wall of the annular chamber and a turbine vane carrier; and an inner diameter mounting arrangement comprising a bracket secured to the turbine vane carrier at a location radially outward of the annular chamber with respect to the central axis of the annular chamber, discrete from the outer diameter mounting arrangement, and in a way that permits relative radial movement and prevents relative axial movement between an inner wall of the annular chamber and the turbine vane carrier, wherein the bracket is configured as a cantilever support with radial freedom for the inner wall.

2. The gas turbine engine ducting arrangement of claim 1, wherein the outer diameter mounting arrangement comprises a radially oriented outer diameter flange of the annular chamber and a radially oriented outer mount groove fixed with respect to the turbine vane carrier in which the annular chamber outer diameter flange resides.

3. The gas turbine engine ducting arrangement of claim 2, wherein the outer diameter mounting arrangement further comprises an anti-rotation arrangement comprising a spline fixed with respect to the turbine vane carrier and residing in a spline groove in the annular chamber outer diameter flange.

4. The gas turbine engine ducting arrangement of claim 1, wherein the bracket moves radially in response to radial movement the annular chamber.

5. The gas turbine engine ducting arrangement of claim 4, wherein a vane carrier end of the bracket comprises a radially oriented flange configured to reside in an inner mount groove that is fixed with respect to the turbine vane carrier.

6. The gas turbine engine ducting arrangement of claim 4, wherein an annular chamber end of the bracket is fixedly secured to the inner wall.

7. The gas turbine engine ducting arrangement of claim 4, wherein the bracket is: secured to the turbine vane carrier at a vane cattier end; secured to the annular chamber at an annular chamber end; and fixedly secured to the ducting arrangement at a point on the bracket in between the vane carrier end and the annular chamber end.

8. The gas turbine engine ducting arrangement of claim 1, wherein the bracket is configured such that relative thermal growth of the bracket with respect to the annular chamber pre-stresses the inner wall in a manner that is effective to counter pressure-induced forces acting to move the inner wall with respect to the outer wall.

9. The gas turbine engine ducting arrangement of claim 1, wherein the annular chamber comprises a plurality of chamber arc-sections secured to each other, and wherein bracket is one of a plurality of brackets, wherein each bracket is associated with a respective chamber arc-section.

10. The gas turbine engine ducting arrangement of claim 1, further comprising a supplemental support arrangement configured to provide support for an additional location of the ducting arrangement, wherein the additional location is secured to the bracket at a supplemental support point between a vane carrier end and an annular chamber end of the bracket.

11. The gas turbine engine ducting arrangement of claim 10, wherein the additional location is fixedly secured to the supplemental support point.

12. The gas turbine engine ducting arrangement of claim 10, wherein the additional location and the supplemental support point are in sliding contact.

* * * * *